US006288408B1

(12) United States Patent
Durocher et al.

(10) Patent No.: US 6,288,408 B1
(45) Date of Patent: Sep. 11, 2001

(54) MULTIPULSE INFRARED COUNTERMEASURES SYSTEM

(75) Inventors: Hector R. Durocher; John R. Kreick, both of Nashua, NH (US)

(73) Assignees: BAE Systems Information; Electronic Systems Integration Inc., both of Nashua, NH (US)

( * ) Notice: Subject to any disclaimer, the term of this patent is extended or adjusted under 35 U.S.C. 154(b) by 0 days.

(21) Appl. No.: 05/902,587

(22) Filed: May 4, 1978

(51) Int. Cl.[7] ..... G01J 1/00; G02B 26/08; F21V 7/00

(52) U.S. Cl. ..... 250/504 R; 250/495.1; 359/298; 362/291; 362/305; 362/350

(58) Field of Search ..... 250/495, 495.1, 250/504 R, 504; 340/25, 366 F; 362/291, 305, 350; 359/298

(56) References Cited

U.S. PATENT DOCUMENTS

| | | | | |
|---|---|---|---|---|
| 1,101,683 | * | 6/1914 | Cote | 362/35 |
| 1,864,696 | * | 6/1932 | Steele et al. | 362/305 |
| 3,644,730 | * | 2/1972 | Ogle, Jr. et al. | 362/347 |
| 3,797,395 | * | 3/1974 | Tyroler | 250/495 |
| 3,978,342 | * | 8/1976 | Hagen et al. | 250/495 |

* cited by examiner

*Primary Examiner*—Stephen C. Buczinski

(57) ABSTRACT

An infrared countermeasures system is provided by ganging a plurality of modulators each of which modulates the output of a radiant source to generate at least one collimated beam of radiation. The modulators are so disposed with respect to each other that the beams generated the reby are staggered in angular phase. When the modulators are rotated together they will provide at a point in space remote therefrom a signal comprising a burst of pulses followed by a dead time when no signal is present.

12 Claims, 2 Drawing Sheets

MULTIPULSE INFRARED COUNTERMEASURES SYSTEM

BACKGROUND OF THE INVENTION

This invention relates to infrared countermeasures systems and more particularly to multipulse infrared countermeasures systems.

Modulated infrared sources are employed to countermeasure heat seeking missiles which home in on the heat generating portions of a target such as the engines of an airplane or helicopter. Certain of such systems provide a counter measuring signal to a heat seeking missile through spatial modulation by sweeping a beam in space. Reflective optics are rotated about a source of infrared radiation such that the missile receives a pulse of energy each time the beam passes the missile.

While illuminating the missile with single pulses of infrared radiation provides an effective countermeasure against the missile, it has been determined that better protection can be afforded by periodically illuminating the missile with bursts of pulses rather than single pulses. Prior to the present invention, the only method of obtaining pulse bursts was to provide concentric modulators driven at different speeds wherein a source is modulated by a first modulator and the output of the first modulator is further modulated by a second modulator. While this system performs more than adequately, it is limited in the amount of achievable gain, since the output from the first modulator is not reimaged prior to being applied to the second modulator. Furthermore, this system requires multiple drives since the modulators must be run at different speeds to achieve multipulse operation. This later system is disclosed in U.S. patent application Ser. No. 543, 299, filed by the inventors of this application on Jan. 20, 1975, and is assigned to the assignee of the present application.

SUMMARY OF THE INVENTION

Accordingly, it is an object of this invention to provide an improved infrared countermeasures system.

It is another object of this invention to provide a high gain counter-measures system which illuminates a missile with bursts of pulses.

Briefly, in one embodiment a plurality of modulators is provided in which each collects and collimates the energy from a radiant source to form a beam. The modulators are ganged in such a fashion that the beams therefrom are angularly phased such that when the ganged modulators are rotated, the beams are swept past points in space to generate at such points a signal comprising a burst of pulses followed by a substantial dead time.

BRIEF DESCRIPTION OF THE DRAWINGS

The above-mentioned and other features and objects of this invention will become more apparent by reference to the following description taken in conjunction with the accompanying drawings, in which.

DESCRIPTION OF PREFERRED EMBODIMENTS

Figure 1:
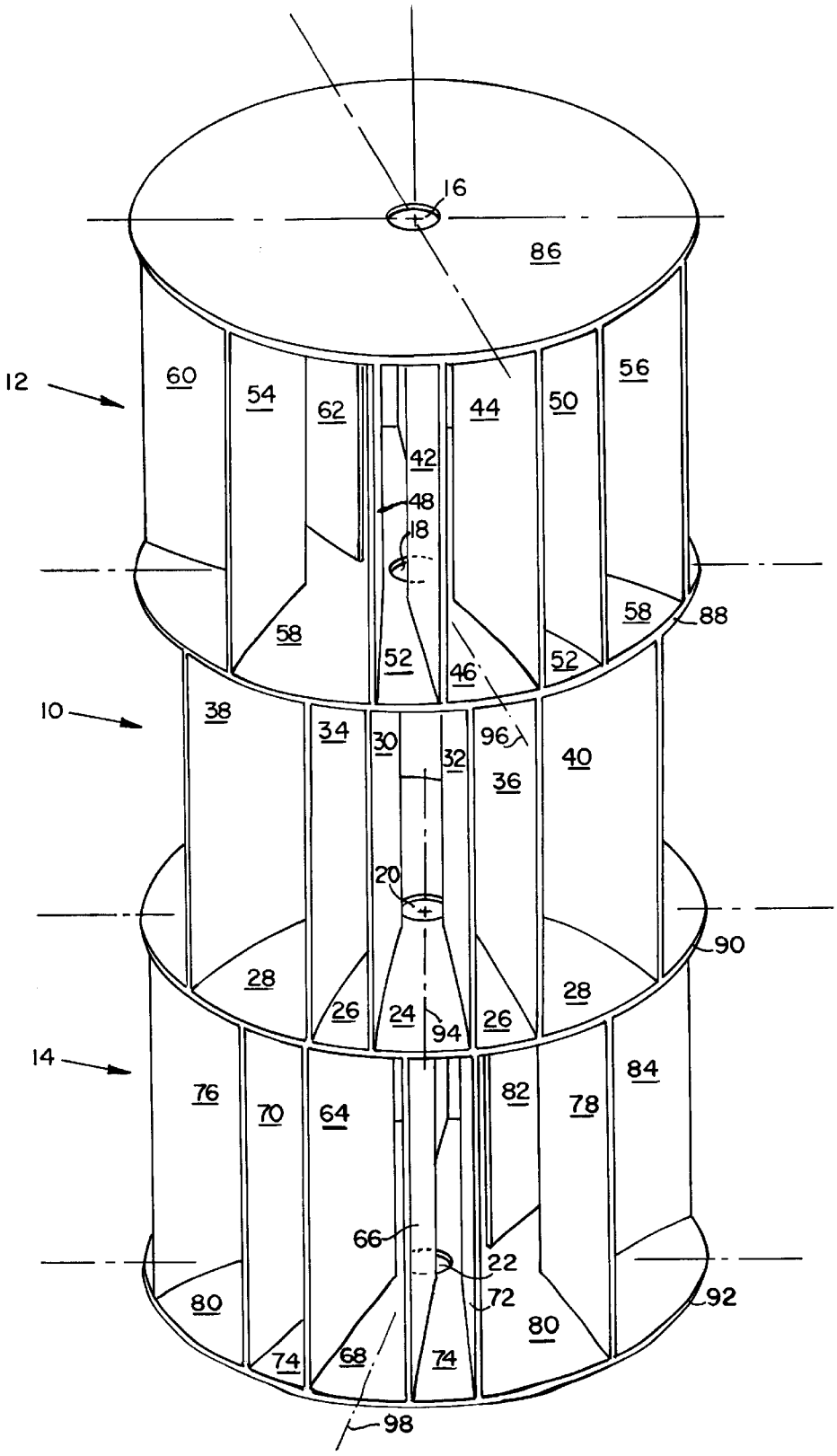
FIG. 1 is a perspective view of a triaxial cavity modulator.

Referring now to FIG. 1 of the drawings, there is illustrated thereby a modulator for an improved infrared countermeasures system. The object of this system is to provide bursts of pulses of infrared energy which when received by a heat seeking missile will cause the missile to avoid the target carrying the countermeasure system at which it is directed.

Figure 2:
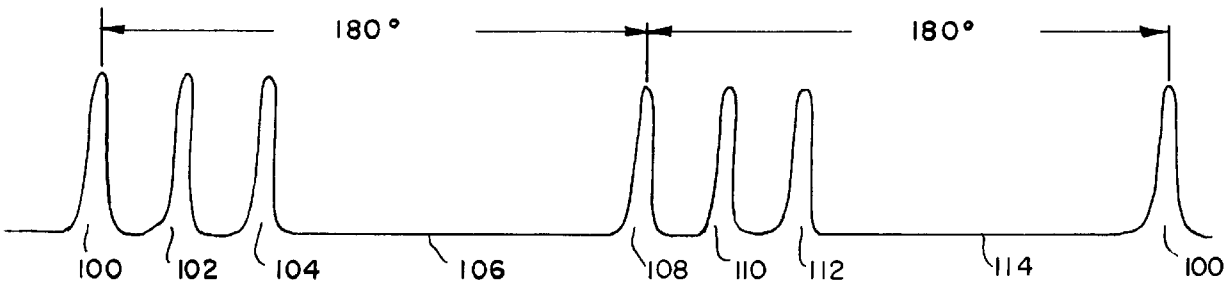
FIG. 2 is a drawing of a typical waveform obtained when the modulator of FIG. 1 is employed to modulate a source of radiant energy.

The output of such a countermeasures system will provide a multi-pulse (three in this example) signal typically as shown in FIG. 2 of the drawings.

Referring again to FIG. 1, the modulator includes three ganged modulators, 10, 12, and 14, each of which is made up of elements to properly shape the output from a source (not shown) which is disposed within the center of the modulators 10, 12 and 14 in the holes 16, 18, 20, and 22.

Looking at modulator 10, it is seen that it includes three cavities, 24, 26, and 28. Cavity 24 is defined by a pair of cylindrical parabolas, 30, 32; cavity 26 is defined by a pair of cylindrical parabolas, 34, 36; and cavity 28 is defined by a pair of cylindrical parabolas, 38, 40.

The cylindrical parabolas 30, 32; 34, 36; and 38, 40 collect and collimate the energy radiated from a source of radiation which would be disposed within the holes 16–22 such that a high intensity beam is formed. Accordingly, when the modulator 10 is rotated about the radiation source, spatial modulation will be provided at points in space remote from the source. Therefore, a single pulse of energy will be received at a point in space for each complete revolution of modulator 10. If a pulse repetition frequency (PRF) N/min is desired, the modulator must be rotated at N RPM.

To reduce the speed of the modulator and yet achieve the same PRF, it is well known to provide additional reflecting optics on the same modulator to generate multiple beams. Thus, to reduce the RPM of modulator 10 by one-half N/2 RPM and still achieve N PRF, a second set of reflecting optics is arranged on the modulator 10. This second set of reflecting optics is identical to the first set (cylindrical parabolas 30, 32; 34, 36; and 38, 40) but disposed on the back side of the modulator 10 (not shown) 180° from the first set shown. Therefore, two beams would be generated by modulator 10 displaced 180° apart such that if the modulator was rotated at a speed of N/2 RPM, a point in space would receive pulses at a PRF of N.

The modulator 10 as described is the subject matter of U.S. patent application Ser. No. 879, 541, filed Feb. 21, 1978, by the inventors of this application and assigned to the assignee of this application. While three cylindrical parabolas are shown to form each beam, more or less can be used, and the manner in which an individual beam is developed forms no part of the present invention.

As mentioned earlier, the object of this invention is to provide high intensity bursts of pulses at points in space rather than single pulses as described with respect to modulator 10. The preferred manner of accomplishing this is to provide additional modulators 12 and 14 (for the case where bursts made up of three pulses are required.)

Modulators 12 and 14 are constructed identically to modulator 10, and the modulators 10, 12, and 14 are disposed to rotate together to modulate a source of radiation.

While the modulators 12 and 14 are constructed like modulator 10, the arrangement of the reflecting optics forming the beams are angularly displaced from the reflecting optics forming the beams of modulator 10.

One beam from modulator 12 is derived by collecting and collimating the output of a source contained in the center of the modulator by cylindrical parabolas 42 and 44 forming a cavity 46; 48 and 50 forming a cavity 52; and 54 and 56 forming a cavity 58. The cylindrical parabola sections 60 and 62 of modulator 12 are employed to form a second beam 180° displaced from 5 the beam formed by parabolas 42, 44, 48, 50, 56, and 58 in order to generate two beams by modulator 12 as mentioned earlier with respect to the description of modulator 10.

The third modulator 14 is again constructed similarly to modulators 10 and 12; however, with the reflecting beam forming optics displaced with respect to those of the modulators 10 and 12. One beam from modulator 14 is formed by cylindrical parabolas 64 and 66 forming a cavity 68, 70 and 72 forming a cavity 74, and 76 and 78 forming a cavity 80. The cylindrical parabola elements 82 and 84 form the second beam from modulator 14 in conjunction with other cylindrical parabola elements (not shown).

The cylindrical parabolas of the modulators 10, 12 and 14 are disposed between plates 86, 88, 90, and 92. Each of the elements of the cylindrical parabolas is preferably made of gold-plated stainless steel with polished optical surfaces to provide maximized reflective surface quality in the infrared portion of the spectrum.

The beam forming optics illustrated for the modulators 10, 12, and 14 are phased so that the beams they provide will be likewise phased. Note that the center of one beam from modulator 10, illustrated by center line 94 is angularly displaced from the center of one beam from modulator 12, illustrated by center line 96. In like fashion the center of one beam from modulator 14, illustrated by center line 98, is angularly displaced from the center of the beams from the modulators 10 and 12.

The second beam forming optics located on each of the modulators 10, 12, and 14 are spaced 180° from the illustrated beam forming optics such that the second beam forming optics will also form beams displaced from one another.

The output of the entire modulator will thus be a waveform as shown in FIG. 2, specifically a burst of three pulses 100, 102, and 104 followed by a dead time 106, followed by three more pulses 108, 110, and 112 from the second sets of beamforming optics not illustrated in whole in FIG. 1.

This burst is again followed by a dead time 114. Thus in one 360° revolution of the modulator of FIG. 1 about a source, two bursts of pulses will be generated at points in space remote from the modulator. In one embodiment of the invention, the pulses in any three pulse burst are separated from their adjacent pulses by approximately 15°.

Figure 3:
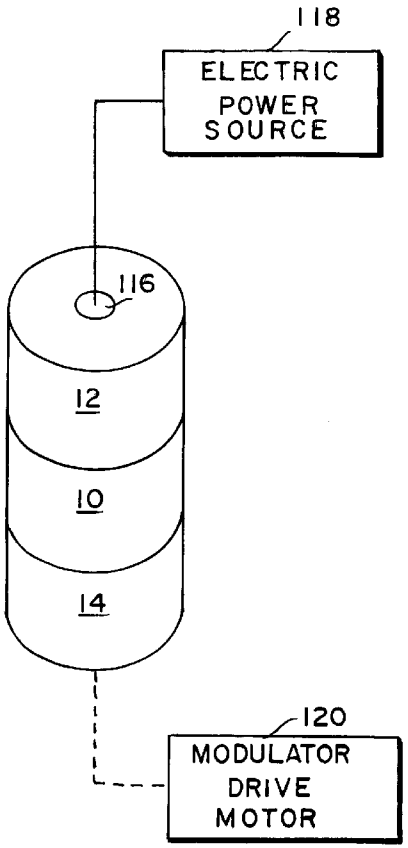
FIG. 3 is a simplified schematic of an infrared countermeasures system employing the modulator of FIG. 1.

A simplified schematic of a mechanically modulated infrared radiation countermeasures system employing the modulator of FIG. 1 is illustrated in FIG. 3. A source of radiant energy 116 is disposed in the center of the modulators 10, 12, and 141 The source 116 is preferably a rod, typically silicon carbide, heated electrically from a source 118. The modulators 10, 12, and 14 are constructed to rotate together and are typically driven by a drive motor 120. When the modulators 10, 12, and 14 are 20 rotated about the source 116, the reflective optics of the modulators form be beams which at points in space remote from the countermeasures system produce a waveform like that shown in FIG. 2, specifically burst of pulses separated by dead time.

As is well known, the modulator may be encased in a window, and the window may have filtering properties to limit the output to a desired wavelength.

While the modulator described provides pulse bursts containing three pulses, it is contemplated that bursts of more or less than three pulses can be generated by stacking two or four or more modulators and spacing the reflective optics accordingly. Thus, it is to be understood that the embodiments shown are illustrative only, and that many variations and modifications may be made without departing from the principles of the invention herein disclosed and defined by the appended claims.

We claim:

1. Apparatus for modulating a source of radiant energy, comprising:

a first set of reflective optics having a first center line and adapted to receive energy from a source of radiant energy to form the energy into a first beam;

a second set of reflective optics having a second center line and adapted to receive energy from a source of radiant energy to form the energy into a second beam; and means for stacking said first and second sets of reflective optics such that said center lines of said first and second sets of reflective optics are not parallel and are asymmetrically angularly disposed about a full circle of revolution.

2. Apparatus as defined in claim 1, further including:

a third set of reflective optics having a third center line and adapted to receive energy from a source of radiant energy to form the energy into a third beam;

a fourth set of reflective optics having a fourth center line and adapted to receive energy from a source of radiant energy to form the energy into a fourth beam;

said third set of reflective optics disposed on the same plane as said first set of reflective optics and said third center line being 180° from said first center line;

said fourth set of reflective optics disposed on the same plane as said second set of reflective optics and said fourth center line being 180° from said second center line.

3. Apparatus as defined in claim 1, further including:

a third set of reflective optics having a third center line and adapted to receive energy from a source of radiant energy to form a third beam; and means for stacking said third set of reflective optics with said first and second sets of reflective optics such that said center line of said third set of reflective optics is not parallel with said first and second sets of reflective optics.

4. Apparatus as defined in claim 3, further including:

a fourth set of reflective optics having a fourth center line and adapted to receive energy from a source of radiant energy to form the energy into a fourth beam;

a fifth set of reflective optics having a fifth center line and adapted to receive energy from a source of radiant energy to form the energy into a fifth beam;

a sixth set of reflective optics having a sixth center line and adapted to receive energy from a source of radiant energy to form the energy into a sixth beam;

said fourth, fifth, and sixth sets of reflective optics, respectively, disposed on the same planes as said first, second, and third sets of reflective optics, respectively, and said fourth, fifth, and sixth center lines, respectively, being 180° from said first, second, and third center lines, respectively.

5. A modulated infrared source, comprising:

a high intensity infrared source;

a first modulating means arranged about said source to receive energy therefrom to generate a first beam;

a second modulating means arranged about said source to receive energy therefrom to generate a second beam; and means for stocking said first and second modulating means such that said beams are not parallel and are asymmetrically disposed about said source such that by rotating said modulating means about said source said beams will produce pulse bursts at points in space.

6. Apparatus as defined in claim 5 wherein said first and second modulating means, respectively, also receive energy from said source to generate third and fourth beams, respectively, displaced 180° from said first and second beams, respectively.

7. Apparatus as defined in claim 5, further including:

a third modulating means arranged about said source to receive energy therefrom to generate a third beam; and means for stacking said third modulating means with said first and second modulating means such that said first, second, and third beams are not parallel and are asymmetrically disposed about said source.

8. Apparatus as defined in claim 7 wherein said first, second, and third modulating means, respectively, also receive energy from said source to generate fourth, fifth, and sixth beams, respectively, displaced 180° from said first, second, and third beams respectively.

9. Apparatus for countermeasuring a heat seeking missile approaching a heat radiating target in which the heat seeking missile has a guidance system, comprising:

an infrared source at said target for producing high intensity radiant energy;

first means responsive to said high intensity radiant energy for generating a first beam;

second means responsive to said high intensity radiant energy for generating a second beam above said first beam, said second beam angularly displaced from said first beam;

means for rotating said first and second means responsive so as to generate a signal in space for causing the guidance system in said heat seeking missile to guide said missile away from said target;

the spatial relationship of said first and second beams being such so as to generate a signal in space comprising a pulse burst separated by dead time wherein the space between pulses of a burst is less than the space between pulse bursts.

10. Apparatus as defined in claim 9, further including third and fourth means, respectively, responsive to said high intensity radiant energy for generating third and fourth beams, respectively, displaced 180° from said first and second beams, said third and fourth beams providing another pulse burst separated from the first mentioned pulse burst by 180°.

11. Apparatus as defined in claim 9, further including third means responsive to said high intensity radiant energy for generating a third beam below said first beam and angularly displaced from said first and second beams, the spatial relationship of said third beam with respect to said first and second beams being such that the signal in space will include a pulse in said pulse burst from said third beam.

12. Apparatus as defined in claim 11, further including fourth, fifth, and sixth means, respectively, responsive to said high intensity radiant energy for generating fourth, fifth, and sixth beams, respectively, displaced 180° from said first, second, and third beams and providing another pulse burst separated from the first mentioned pulse burst by 180°.

* * * * *